US008245798B2

(12) United States Patent
Nava et al.

(10) Patent No.: US 8,245,798 B2
(45) Date of Patent: Aug. 21, 2012

(54) FEMALE PART AND A METHOD FOR MANUFACTURING FEMALE PARTS

(75) Inventors: Peter Nava, Sandviken (SE); Peter Sörensen, Storvik (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/300,839

(22) PCT Filed: May 11, 2007

(86) PCT No.: PCT/SE2007/000457

§ 371 (c)(1), (2), (4) Date: Feb. 9, 2009

(87) PCT Pub. No.: WO2007/133145

PCT Pub. Date: Nov. 22, 2007

(65) Prior Publication Data

US 2009/0152014 A1 Jun. 18, 2009

(30) Foreign Application Priority Data

May 17, 2006 (SE) ..... 0601118

(51) Int. Cl.
*E21B 17/042* (2006.01)
*E21B 4/06* (2006.01)
*F16L 15/06* (2006.01)

(52) U.S. Cl. ..... 175/320; 175/293; 403/343; 285/334; 285/355; 285/390

(58) Field of Classification Search ..... 175/320, 175/293, 414; 403/343; 285/334, 333, 355, 285/390; 166/241.1, 242.6
See application file for complete search history.

(56) References Cited

U.S. PATENT DOCUMENTS

| | | | | |
|---|---|---|---|---|
| 2,062,407 | A * | 12/1936 | Eaton | 285/334 |
| 3,489,437 | A * | 1/1970 | Duret | 285/55 |
| 3,574,373 | A * | 4/1971 | Le Derf et al. | 403/296 |
| 4,384,737 | A * | 5/1983 | Reusser | 285/334 |
| 4,687,368 | A * | 8/1987 | Eklof et al. | 403/343 |
| 4,917,409 | A * | 4/1990 | Reeves | 285/334 |
| 4,968,068 | A * | 11/1990 | Larsson | 285/390 |
| 5,984,030 | A * | 11/1999 | Larsson et al. | 175/414 |
| 6,196,698 | B1 * | 3/2001 | Maglica | 362/205 |
| 6,293,360 | B1 | 9/2001 | Liljebrand et al. | |
| 6,494,275 | B2 * | 12/2002 | Åsberg et al. | 175/401 |
| 6,991,267 | B2 * | 1/2006 | Ernst et al. | 285/333 |
| 7,210,710 | B2 * | 5/2007 | Williamson et al. | 285/333 |

(Continued)

FOREIGN PATENT DOCUMENTS

| | | |
|---|---|---|
| RU | 2 155 852 | 9/2000 |

(Continued)

*Primary Examiner* — Jennifer H Gay
(74) *Attorney, Agent, or Firm* — Morgan, Lewis & Bockius LLP

(57) ABSTRACT

A female part intended for top hammer-drilling equipment includes a thread in the form of a ridge in a wall. The ridge is delimited by a crest and two flanks between which a likewise helical groove having a bottom runs. An end the of the groove is defined by a borderline, which separates the groove bottom from a part surface formed in the inside of the wall, the width of which part surface successively decreases in the peripheral direction, and which has a rotationally symmetrical shape essentially similar to the rotationally symmetrical basic shape of the thread.

8 Claims, 4 Drawing Sheets

U.S. PATENT DOCUMENTS

Figure 1:
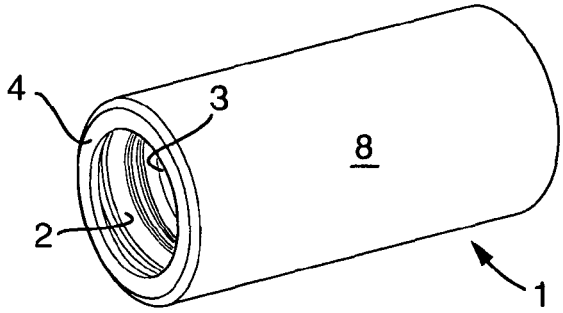

| | | | | |
|---|---|---|---|---|
| 7,431,347 | B2 * | 10/2008 | Ernst et al. | 285/333 |
| 2002/0074797 | A1 * | 6/2002 | Liljebrand et al. | 285/333 |
| 2003/0075924 | A1 * | 4/2003 | Olivier | 285/331 |
| 2004/0130152 | A1 * | 7/2004 | DeLange et al. | 285/334 |
| 2005/0217901 | A1 | 10/2005 | Hedlund et al. | |
| 2006/0006648 | A1 * | 1/2006 | Grimmett et al. | 285/333 |
| 2007/0228729 | A1 * | 10/2007 | Grimmett et al. | 285/333 |
| 2009/0152014 | A1 * | 6/2009 | Nava et al. | 175/414 |
| 2010/0123311 | A1 * | 5/2010 | Church | 285/334 |
| 2010/0140929 | A1 * | 6/2010 | Nava | 285/333 |

FOREIGN PATENT DOCUMENTS

| | | |
|---|---|---|
| RU | 2 204 684 | 5/2003 |
| SU | 267546 | 1/1970 |
| WO | WO 99/49176 | 9/1999 |
| WO | WO 00/19056 | 4/2000 |
| WO | WO 01/38686 | 5/2001 |
| WO | WO 02/44512 | 6/2002 |
| WO | WO 03/042493 | 5/2003 |
| WO | WO 2004/003334 | 1/2004 |

* cited by examiner

FEMALE PART AND A METHOD FOR MANUFACTURING FEMALE PARTS

TECHNICAL FIELD OF THE INVENTION

In a first aspect, this invention relates to a female part intended for top hammer-drilling equipment and of the type that is defined in the preamble of claim 1.

In another aspect, the invention also relates to a method for manufacturing female parts according to the preamble of claim 5.

U.S. Pat. No. 6,293,360 shows a female part for rock-drilling equipment for percussive drilling or top hammer drilling. Characteristic of this female part, and other female parts for the same purpose, which in practice may be drill bits, connectors or coupling sleeves, drill rods having MF couplings (where M=male thread and F=female thread), reduction sleeves and the like, is that it comprises a female thread intended to co-operate with a male thread included in a male part of the equipment. Such female threads are generally provided by internal turning of a hollow work piece, more precisely by means of a turning tool, which in modern versions comprises a replaceable turning insert of cemented carbide or the like, and which is fed axially as well as radially (longitudinal feed and transverse feed, respectively) at the same time as the work piece is brought to rotate. Previously known turning technique has required machining of the work piece in a plurality of consecutive passes, during which the groove between the flanks of the thread ridge successively is made deeper and deeper until the final thread profile has been obtained. In order to allow the turning insert and the groove processed by the same to run out of the wall material at the interior end of the thread positioned closest to the stop shoulder, a particularly clearance space or groove had to be turned inside the hollow space before the proper chasing was started. In order to allow the screw-cutting tool to finish the thread, said clearance space has to have a diameter that is larger than the diameter of the groove bottom or root of the finished thread. However, the presence of such a clearance space furthest inside the hollow space entails not only the disadvantage that sharp material edges arise at the exit of the thread groove into the clearance space, but also the disadvantage that the material thickness of the wall outside the space is reduced. In such a way, the female part grows weak mechanically as well as in the respect of fatigue, whereby the service life of the female part is shortened unnecessarily.

In U.S. Pat. No. 6,293,360, a turning method is provided, by means of which a male thread may be given successively decreasing height and width from the full profile to a zero point, where the thread ridge ceases. However, this turning method does not eliminate the need for the weakening clearance space, when an internal thread is to be formed in a female part. Thus, FIGS. 1 and 3 in said patent document clearly show how the internal part of the thread of the female part in question is terminated adjacent to a rotationally symmetrical clearance space having a larger diameter than the thread groove.

OBJECTS AND FEATURES OF THE INVENTION

The present invention aims at obviating the above-mentioned disadvantages of previously known female parts for top hammer-drilling equipment and at providing an improved female part. Therefore, a primary object of the invention is to provide a mechanically strong female part having a largest inner diameter in the bottom of the thread groove.

According to the invention, the above-mentioned object is attained by the features defined in the characterizing portion of claim 1. Preferred embodiments of the female part according to the invention are further defined in the dependent claims 2-4.

In an additional aspect, the invention also relates to a method for manufacturing female parts of the mentioned type. The features of this method are seen in the independent claim 5.

BRIEF DESCRIPTION OF THE APPENDED DRAWINGS

Figure 2:
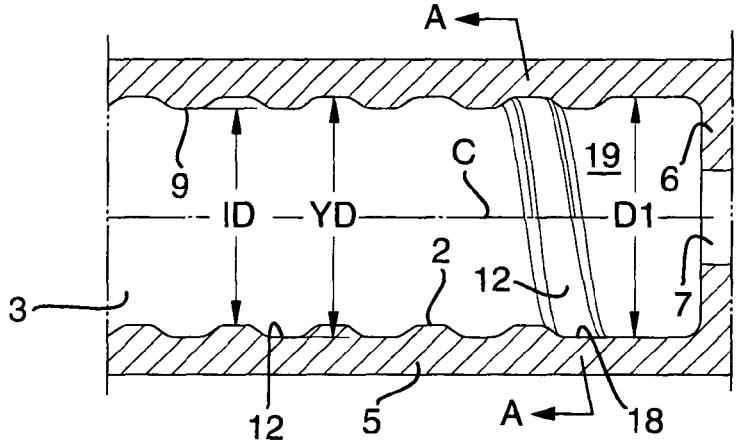
Figure 3:
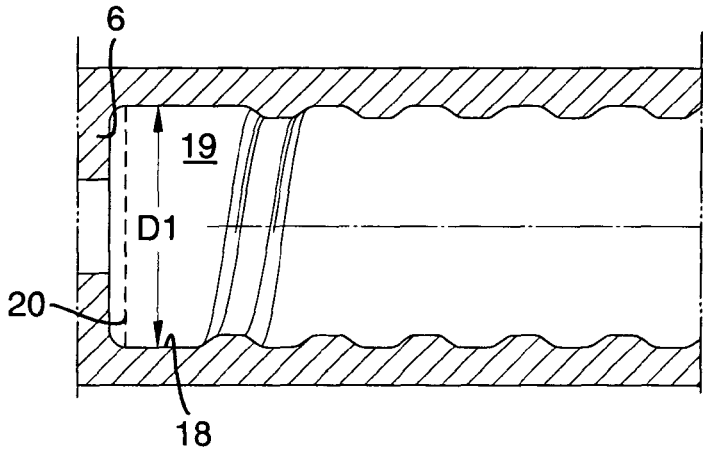
Figure 4:
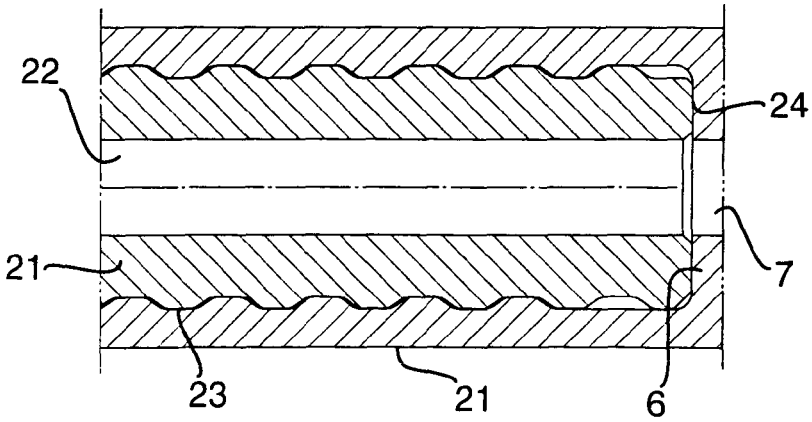
Figure 5:
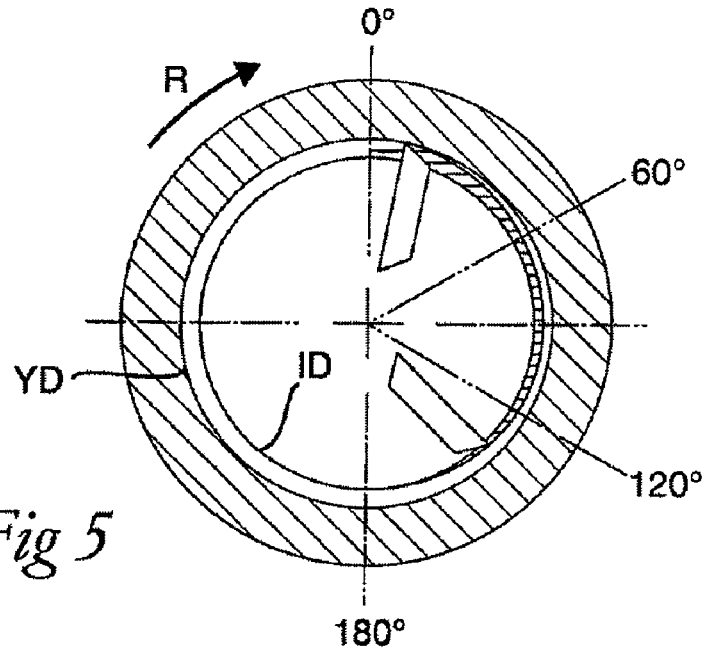
Figure 6:
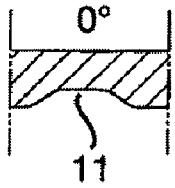
Figure 6:
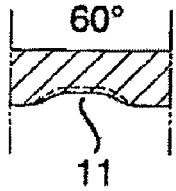
Figure 6:
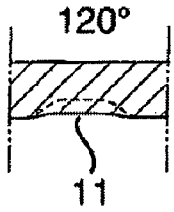
Figure 6:
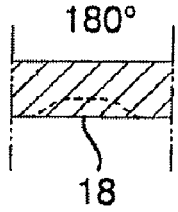
Figure 7:
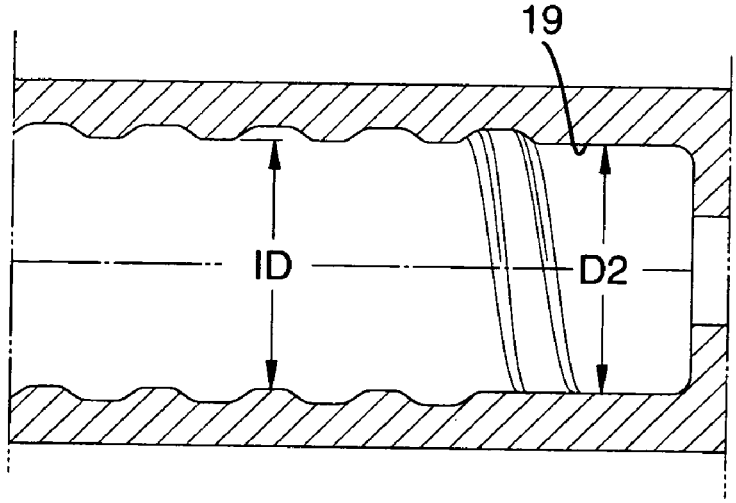
Figure 8:
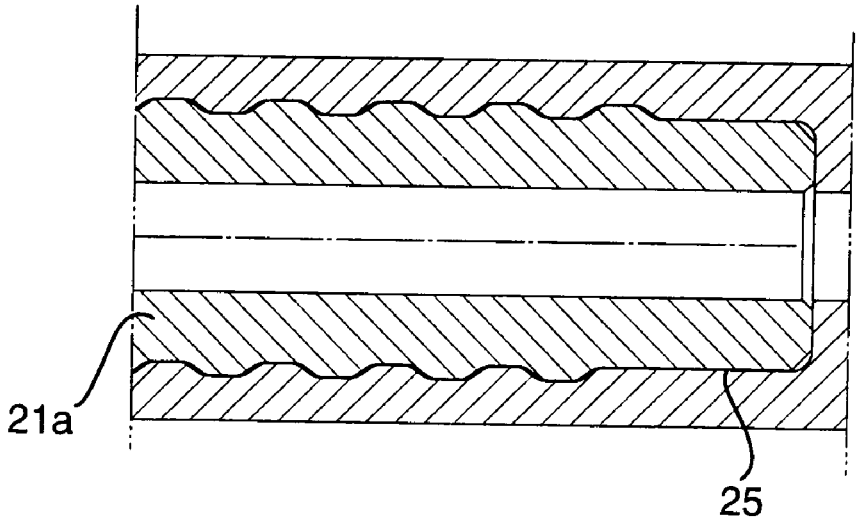
Figure 9:
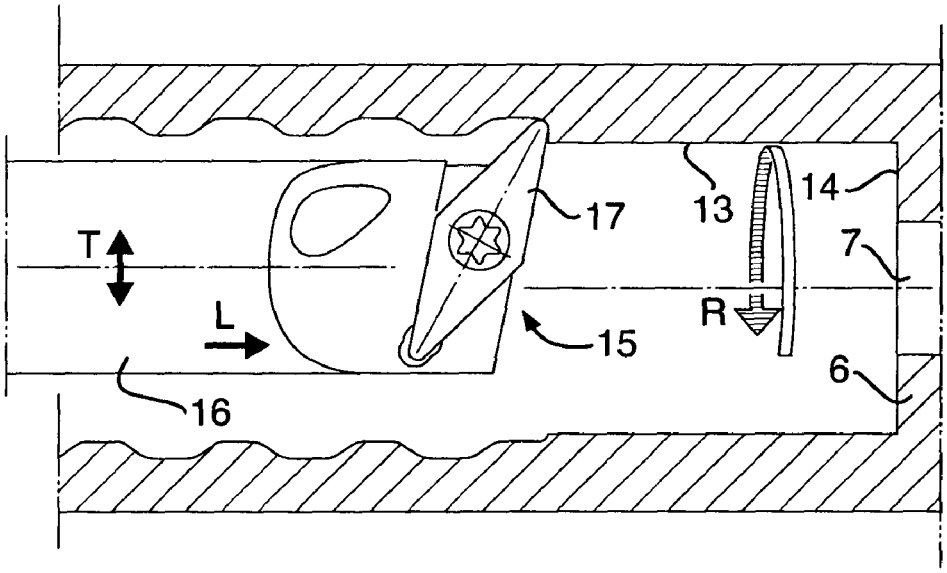
Figure 10:
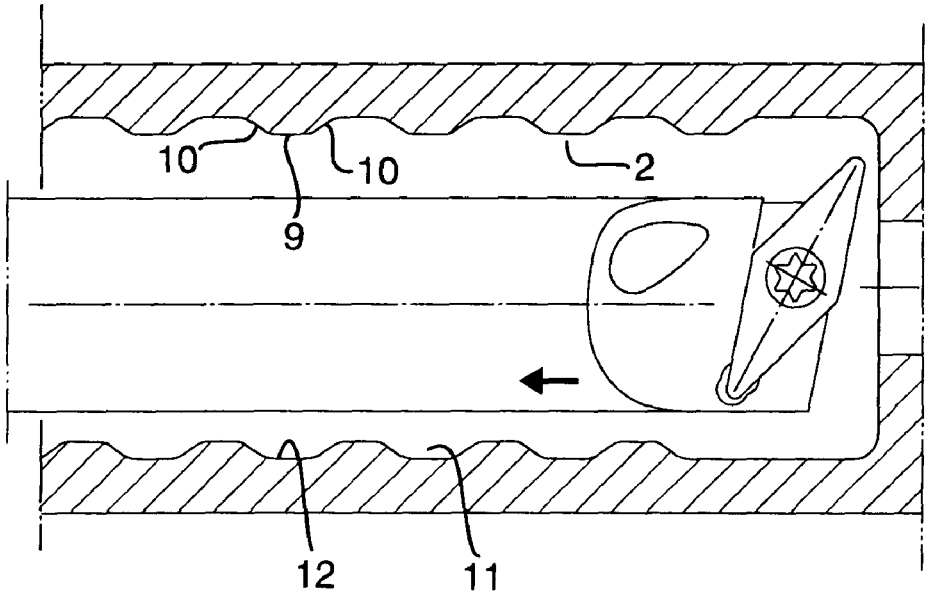

In the drawings:

FIG. 1 is a is a perspective view of a female part according to the invention, FIG. 2 is a partial longitudinal section through the female part, showing parts of an internal thread according to the invention, the inside of the female part being regarded from a side, FIG. 3 is a longitudinal section corresponding to FIG. 2 as viewed from the opposite side, FIG. 4 is a longitudinal section showing a co-operating male part inserted into the inside of the female part, FIG. 5 is a cross section A-A in FIG. 2, FIG. 6(*a*) is a detailed section showing how the groove of the thread is terminated under a half-turn with successively decreasing depth, FIG. 6(*b*) is another detailed section showing how the groove of the thread is terminated under a half-turn with successively decreasing depth, FIG. 6(*c*) is another detailed section showing how the groove of the thread is terminated under a half-turn with successively decreasing depth, FIG. 6(*d*) is another detailed section showing how the groove of the thread is terminated under a half-turn with successively decreasing depth, FIG. 7 is a longitudinal section through an alternative embodiment of the female part, FIG. 8 is a longitudinal section showing a male part inserted into the female part according to FIG. 7, FIG. 9 is an enlarged longitudinal section showing a work piece during turning by means of a turning tool, and FIG. 10 is a corresponding longitudinal section showing the tool after finished chasing.

DETAILED DESCRIPTION OF PREFERRED EMBODIMENTS OF THE INVENTION

In FIG. 1, a female part 1 is shown having a visible female thread 2 formed on the inside of a cylindrical wall that delimits a hollow space 3, which mouths in one end 4 of the female part. In practice, the female part may be a connector sleeve, which comprises two hollow spaces separated by a partition wall or a stop shoulder, both of which spaces comprise a female thread. However, henceforth, only one of said female threads will be discussed.

Reference is now made to FIGS. 2-6, which illustrate a first embodiment of the female thread 2, wherein 5 in FIG. 2 generally designates the cylindrical wall on the inside of which the thread is formed, while 6 designates a stop shoulder 6 that separates the hollow space 3 from second, analogous hollow space (not shown). The two hollow spaces communicate with each other via a central hole 7 through which flush medium, such as water and/or air, can pass from, for instance, a drill rod to another drill rod.

In this case, the thread 2 is in the form of a trapezoidal thread, which in the example is cylindrical and is defined by a centre axis C. In the case also the outside of the female part is cylindrical, also the external envelope surface 8 will be concentric with the centre axis C.

Before the embodiment shown in FIGS. 2-6 is further described, reference is made to FIGS. 9 and 10, which schematically illustrate the turning of a work piece that is to be formed with the thread in question. From these figures, it is seen that the thread, in its entirety designated 2, is a ridge that extends helically along the inside of the wall and is delimited by a crest 9 and two flanks 10 between which a groove 11 having a bottom 12 runs. Because the thread profile is trapezoid, the thread crest, the flanks and the groove bottom are delimited by straight generatrices. The actual profile shape is, however, in no way critical. Thus the thread may be, for instance, a rope thread or have another arbitrary profile shape. In FIG. 2 the diameter of the groove bottom or root 12 is designated YD, while the diameter of the thread crest 9 is designated ID.

The machining of the work piece shown in FIGS. 9 and 10 is carried out by means of the recently developed turning technique that allows chasing in a single pass (even if a plurality of passes of course is feasible). The work piece is preprepared by forming a cylindrical hollow space, the cylinder surface of which is designated 13 in FIG. 9 and the end surface of which is designated 14. The forming may be carried out by means of drilling/milling, advantageously also the central hole 7 being drilled. During the turning of the thread, the turning tool in its entirety designated 15 is used, which in a traditional way is composed of a shaft 16 and a replaceable turning insert 17. Said tool is fed longitudinally in the direction of the arrow L at the same time as the same is fed transversely in the direction T. The special with the new turning technique is that the transverse feed T is effected in the form of fast, intermittent motions in the radial direction, the tool being controlled by software that gives the desired profile shape. However, the longitudinal feed is carried out in the traditional way by a continuous axial movement of the tool, wherein the feed is moderate (e.g., 0.2 mm/s). During the turning, the work piece is rotated in the direction of the arrow R.

It should be noted that the cylinder wall of the work piece initially is of uniform thickness along the entire length thereof.

When the tool, more precisely the turning insert 17, has entered the material via an entrance not shown but positioned to the left in FIG. 9, a main section is formed in which the thread has full profile, more precisely by the fact that the tool is fed further and further into the hollow space. At an appropriate distance from the stop shoulder 6, the forming of the full-profile thread is terminated and measures are taken to provide an exit in which the thread can run out. This is carried out in the way illustrated in FIGS. 5 and 6, to which now reference is made.

In a selected zero point (0°), a concluding transverse feed sequence is commenced, during which the depth of the groove 11 is successively reduced. In this case, such a depth reduction is carried out under a half-turn, FIGS. 6(*a*) to 6(*d*) illustrating the approximate depth of the groove after 60° and 120° up to 180°, where the groove ceases in a borderline designated 18 (see also FIG. 2), which in this case is an essentially straight line parallel to the centre axis C. As is seen in FIG. 2, the reduction of the depth results in a successive increase of the width of the groove bottom 12, more precisely in such a way that the width successively increases up to the terminating borderline 18.

In FIG. 3, the side of the hollow space opposite to the one shown in FIG. 2 is illustrated, the terminating borderline 18 being shown to the left in FIG. 3. When the tool reaches the borderline 18, the tool stops to carry out radial motions. However, the tool continues the machining of the work piece, viz. by the fact that under continued rotation during at least a half-turn while being retained in the given radial position thereof. In such a way, the successively tapering surface 19 delimited between the terminating thread ridge and the dashed line 20 is generated. This surface has a diameter D1, which in this case corresponds with the diameter YD of the thread groove. In this case, the end line 20 is positioned in the immediate vicinity of the stop shoulder 6. In other words, the thread is terminated as near the stop shoulder as possible.

An imaginary cylinder or imaginary cone (not shown) can be said to coincide with the crest 9 or bottom 10 of the entire female thread, the cylinder or cone also coinciding with the entire part surface 19.

In FIG. 4, it is seen how a male part 21 is inserted into the female part 1. The male part 21 may, for instance, be or be included in a drill rod, which in the traditional way comprises a flush duct 22 and a male thread 23, which co-operates with the described female thread. To the right in FIG. 4, it is clearly seen how the end surface 24 of the male part is pressable against the stop shoulder 6, more precisely in connection with impulsive forces being transferred from one male part to another via the female part.

In FIG. 7, an alternative embodiment is shown in which the completed part surface 19 has a diameter D2 corresponding to the diameter ID of the thread crest, and is extended a distance in relation to the part surface according to FIGS. 2-4. Thus, the part surface 19 can be utilized for guiding the front end of the male part 21A. In the example shown, when the thread is cylindrical, accordingly the surface 19 forms a cylindrical guiding surface, which by a relatively fine fit can co-operate with the inner cylinder surface 25 of the male part, FIG. 8.

Even if the invention above has been described in the context of cylindrical threads, the same is also applicable to conical threads. In both cases, the described part surface 19 can obtain a rotationally symmetrical shape that is essentially congruent with or similar to the rotationally symmetrical basic shape of the thread. In other words, the part surface 19 is conical if the thread is conical. The female part may alternatively be integrated in a rock-drill bit, a connector or coupling sleeve, an MF drill rod or a reduction sleeve.

The disclosures in Swedish patent application No. 0601118-3, from which this application claims priority, are incorporated herein by reference.

The invention is in no way limited to the above-described embodiment but can be freely varied within the limits of the appended claims.

The invention claimed is:

1. A female part for top hammer-drilling equipment, comprising a hollow space defined by a centre axis, said hollow space extends to an opening in a free end of the female part and is delimited by a surrounding wall and by a stop shoulder axially spaced from the free end, a female thread formed on an inside of the wall in the shape of a ridge, which has a rotationally symmetrical shape and extends helically along the inside of the wall, said ridge being concentric with the centre axis of the hollow space, and being delimited by a crest and two flanks between which a helical groove runs, said groove having a bottom, said thread having full profile along a main section of a predetermined length parallel to the centre axis, and comprising a thread end positioned between the full profile section and the stop shoulder and in which the groove runs out, wherein the depth of the groove successively diminishes towards said thread end and is carried out under a half-turn, said thread end being defined by a borderline, which separates the groove bottom from a part surface formed in the inside of the wall, said part surface having the same rotationally symmetrical shape as the thread by having a diameter corresponding with either a diameter of the crest of the thread or a diameter of the groove bottom of the thread.

2. Female part according to claim 1, wherein said part surface extends up to the stop shoulder.

3. Female part according to claim 2, wherein the predetermined dimension also coincides with the entire part surface.

4. Female part according to claim 2 wherein the female part is arranged on a group consisting of a drill bit, connector or coupling sleeve, drill rod having male and female couplings or reduction sleeves.

5. Female part according to claim 1, wherein the predetermined dimension also coincides with the entire part surface.

6. Female part according to claim 5 wherein the female part is arranged on a group consisting of a drill bit, connector or coupling sleeve, drill rod having male and female couplings or reduction sleeves.

7. Female part according to claim 1, wherein the female part is arranged on a group consisting of a drill bit, connector or coupling sleeve, drill rod having male and female couplings or reduction sleeves.

8. A method of manufacturing the female part of claim 1, the method comprising the steps of bringing a hollow work piece to rotate around a centre axis, bringing a turning tool into the hollow space of the work piece, longitudinally feeding the turning tool between the opposite end regions of the hollow space and simultaneously transversally feeding the same radially in order to generate the desired thread profile, wherein the further steps of, during continuous longitudinal feed in one and the same pass, bringing the tool to alternatingly move between radially outer and inner end positions, the outer one of which generates the groove bottom of the full-profile thread and the inner one generates the thread crest thereof, and during a concluding operation successively reducing the radius difference between the two radial end positions to zero in order to terminate the thread groove with a successively diminishing depth up to an end in the shape of a borderline which separates the groove bottom from apart surface formed in the inside of the wall, said part surface having the same rotationally symmetrical shape as the thread by having a predetermined dimension coinciding with either the crest of the thread or its groove bottom.

* * * * *